United States Patent [19]

Sakuma et al.

[11] 4,421,961

[45] Dec. 20, 1983

[54] VACUUM CIRCUIT BREAKER

[75] Inventors: Shinzo Sakuma, Yokohama; Hifumi Yanagisawa, Sagamihara; Kazuo Tokuhata, Kanagawa; Hiroshi Miyagawa, Yokohama, all of Japan

[73] Assignee: Kabushiki Kaisha Meidensha, Tokyo, Japan

[21] Appl. No.: 235,023

[22] Filed: Feb. 13, 1981

[30] Foreign Application Priority Data

Feb. 14, 1980 [JP] Japan ..... 55-17148

[51] Int. Cl.[3] ..... H01H 33/66

[52] U.S. Cl. ..... 200/144 B

[58] Field of Search ..... 200/144 B

[56] References Cited

U.S. PATENT DOCUMENTS

| | | | |
|---|---|---|---|
| 3,372,258 | 3/1968 | Porter | 200/144 B |
| 3,562,682 | 2/1971 | Ohwada et al. | 335/201 |
| 3,812,314 | 5/1974 | Nonken | 200/144 B |
| 4,351,992 | 9/1982 | Crouch | 200/144 B |

FOREIGN PATENT DOCUMENTS

| | | | |
|---|---|---|---|
| 30852 | 6/1981 | European Pat. Off. . | |
| 33636 | 8/1981 | European Pat. Off. . | |
| 1020081 | 11/1958 | Fed. Rep. of Germany . | |
| 128192 | 11/1977 | Fed. Rep. of Germany . | |
| 131499 | 6/1978 | Fed. Rep. of Germany | 200/144 B |
| 1405144 | 9/1975 | United Kingdom . | |

*Primary Examiner*—Robert S. Macon

*Attorney, Agent, or Firm*—Lowe, King, Price & Becker

[57] ABSTRACT

A vacuum power interrupting device comprising a bell-shaped vacuum power interrupter which includes a bell-shaped metallic casing wherein a pair of electrical contact rods are extended for interrupting a large current with a high voltage, and insulating molded block made of a resin for supporting the bell-shaped vacuum power interrupter. According to the present invention, there is provided a single-phase or three-phase vacuum power interrupting device comprising a vacuum power interrupter which includes a bell-shaped metallic casing, a ceramic insulating circular end plate fitted to the opening end of the bell-shaped metallic casing, and a pair of electrical contact rods having electrical contacts partially extended within the casing, being normally in contact with each other or moving away from each other, and an insulating molded block made of a resin into which the outer peripheral surface of the radially extended portion of the bell-shaped metallic casing and insulating circular end plate are integrally burried, whereby the atmospheric creepage distance from a movable electrical contact rod serving as an electrically charged portion is increased so that the atmospheric dielectric strength of the vacuum power interrupter becomes greater and a larger current with higher voltage can be interrupted.

8 Claims, 3 Drawing Figures

VACUUM CIRCUIT BREAKER

BACKGROUND OF THE INVENTION (1) Field of the Invention

The present invention relates generally to a vacuum circuit breaker, and more particularly to a vacuum power interrupting device for interrupting a large current flow having at least one bell-shaped vacuum power interrupter unit which comprises a vacuum vessel wherein an opening portion of a cup-shaped metallic casing is hermetically sealed with an insulating circular end plate made of a ceramic material and a pair of electrical contacts are installed in the axial direction of the vacuum power interrupter; one is a stationary electrical contact and the other is a movable electrical contact, so that normally they are in contact with each other but the latter is drawn away from the former during a current interruption.

(2) Description of the Prior Art

As compared with a conventional vacuum circuit breaker having at least one vacuum power interrupter unit of the type comprising a vacuum vessel hermetically sealed with a metallic end plate at each end of a cylindrical insulating envelope wherein stationary and movable electrical contacts are installed so that they are normally in contact with each other, but the latter can be moved away from the former, the bell-shaped vacuum interrupter unit described above can open or close a larger current with a high voltage simply by increasing the diameter of the vacuum vessel, that is, the opening end of the bell-shaped metallic casing and the diameter portion of insulating circular end plate fitted thereinto. Simultaneously, the bell-shaped vacuum power interrupter unit can be less expensive and can be fabricated easily by replacing the expensive insulating envelope used in the conventional type described above with such an inexpensive insulating circular end plate made of a single ceramic material.

However, such a bell-shaped vacuum power interrupter unit constituting the circuit breaker has the problem that the outer surface of the insulating circular end plate partially surrounding the vacuum vessel corresponds to an atmospheric creepage distance from an electrically charged portion due to the potential which is rendered by the movable electrical contact rod serving as the electrically charged portion through a bellows mounted on the end plate to another opposed electrically charged portion, i.e., the cup-shaped metallic casing when the movable electrical contact is drawn away from the stationary electrical contact so that the creepage distance of the bell-shaped vacuum power interrupter unit is shorter than that of the conventional vacuum power interrupter unit described above since the creepage distance of the conventional type corresponds to the distance between each end metal plate, thereby the dielectric strength between the movable electrical contact rod and an open end of the bell-shaped metallic casing via the circular end plate not becoming larger and the opening or closing of a larger current being made difficult.

SUMMARY OF THE INVENTION

In respect of the above-described problem, it is an object of the present invention to provide a vacuum power interrupting device having a vacuum power interrupter wherein the outer peripheral surface of the radially extended portion of a metallic casing and insulating circular end plate hermetically sealing the metallic casing are burried into an insulating molded back constituting a supporting frame made of a resin, a pair of electrode supporting poles are integrally formed with the insulating molded block of supporting frame and are disposed at opposite positions outside the peripherary of the metallic casing and the electrode connected to the stationary electrical contact rod is horizontally laid on the pair of electrode supporting poles so that the aerial dielectric strength of the bell-shaped vacuum power interrupter unit can be increased due to the increase of the atmosphere creepage distance, the interruption of a larger current with a higher voltage can be achieved and the body of the bell-shaped vacuum power interrupter unit of the construction described hereinabove can be rigidly mounted onto the insulating molded block.

BRIEF DESCRIPTION OF THE DRAWINGS

The features and advantages of the circuit breaker according to the present invention will be better appreciated from the following description and drawings taken in conjunction with the accompanying drawings in which like reference numerals designate corresponding elements, and in which.

DESCRIPTION OF THE PREFERRED EMBODIMENTS

Reference will be made to the drawings, and first to FIG. 1 which is an elevation of a three-phase vacuum circuit breaker of a preferred embodiment according to the present invention.

Figure 1:
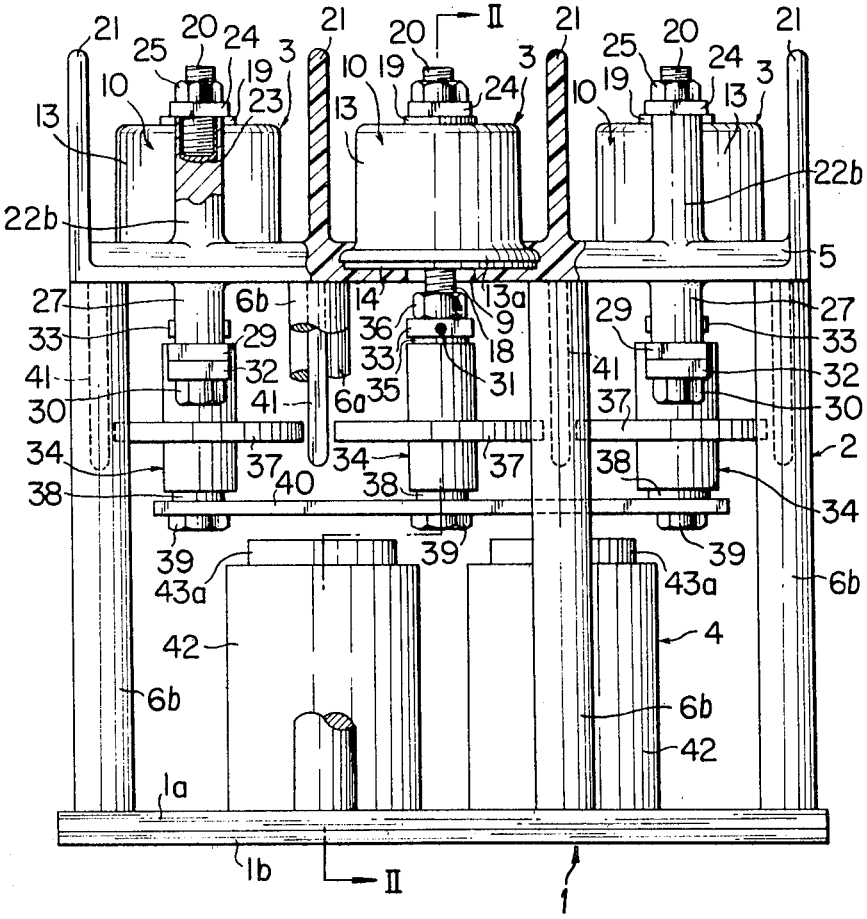
FIG. 1 is an elevation partly in section of a three-phase circuit breaker according to the present invention.

As shown in FIG. 1, the three-phase vacuum circuit breaker substantially comprises an insulating molded block 2 made of a resin mounted on a base plate 1 made of a magnetic material, three-phase bell-shaped vacuum power interrupter units 3 each partially fixed to the insulating molded block 2, and an actuating mechanism 4 mounted on the base plate 1 for simultaneously actuating each of the vacuum power interrupter units 3.

The following describes details of the construction of the vacuum circuit breaker.

The base plate 1, made of a magnetic material such as iron, constitutes a part of a magnetic circuit in an electromagnet to be described hereinafter and is placed at the bottom portion of the vacuum circuit breaker so as to be attached to a switchboard not shown in the drawings.

Figure 2:
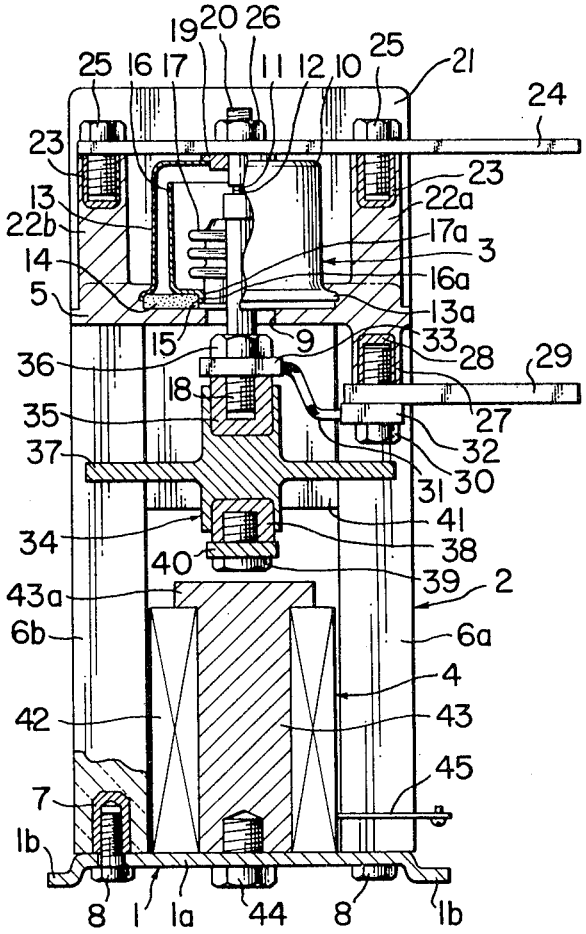
FIG. 2 is a sectional view taken substantially along the lines II—II of FIG. 1.

The base plate 1, also as shown in FIG. 2, is formed of a rectangular sheet-form mounting portion 1*a* and of attaching portions 1*b* bent in the shape of the letter L at both edges thereof through a bending process.

The insulating molded block 2 is mounted on the mounting portion 1*a* of the base plate 1 and is made of a resin such as premix or epoxy resin molded in a casting. The insulating molded block 2 consists of three rectangular sheet-form supporting portions 5 each supporting the vacuum power interrupter unit 3, also shown in FIG. 3, four supporting members 6*a* on the right side in FIG. 2 and four supporting members 6*b* on the left side in FIG. 2 each pair of elongated supporting members 6a and 6b molded integrally with each supporting portion 5 at its each edge and extended in the elongated direction to the base plate 1 so as to support the vacuum power interrupter 3 in a vertical position. A metal fitting 7 is provided at the extended end of each of the elongated supporting members 6a and 6b as shown in FIG. 2. The insulating molded block 2 is mounted on the mounting portion 1a of the base plate 1 by means of bolts 8 fitted into the metal fittings 7 on the elongated supporting members 6a and 6b.

As shown in the drawings, a bore 9 is provided in the supporting portion 5 of the insulating molded block 2 for loosely inserting the movable contact rod 18 of each three-phase vacuum power interrupter unit 3. The three bores 9 are spaced properly along the horizontal position with respect to the elongated direction of these movable contact rods 18. It will be seen that the vacuum power unit 3 are in line and that each phase vacuum power interrupter 3 is disposed coaxially with each bore 9 and is mounted on the supporting portion 5, burried partially thereinto.

Each phase vacuum power interrupter unit 3 is of a self-closing type where the electrical contacts are brought in contact with each other automatically due to the difference between the internal and external air pressures and substantially comprises a vacuum vessel 10, stationary and movable electrical contacts 11 and 12 provided within the vacuum vessel 10 and normally in contact with each other and the latter being drawn away from the former to interrupt a current. In more detail, the vacuum vessel 10 has a bell-shaped profile, the interior of which is evacuated and comprises a bell-shaped metallic casing 13 made of an Fe-Ni-Co alloy or of an Fe-Ni alloy whose opening end forms a lip 13a (also referred to as a radially extended portion) having larger outer diameter portion than its cylinderical portion and an insulating circular end plate 14 made of a ceramic material fitted and hermetically brazed into the lip 13a of the bell-shaped metallic casing 13. Furthermore, a concentric hole 15 is formed at the center of the insulating circuit end plate 14. A cup-shaped arc-shield member 16 made of an Fe-Ni-Co alloy or of an Fe-Ni alloy is housed within the vacuum vessel 10 coaxially with the stationary and movable electrical contact rods 20 and 18. The base portion 16a of the cylindrical arc-shield member 16 is bent internally in the shape of the letter L and a part thereof is hermetically brazed to the insulating circular end plate 14 at its bore portion. The cylindrical portion of the arc-shield member 16 extends vertically with an appropriate space between the cylindrical portion of the casing 16 and stationary and movable electrical contacts 11 and 12. A bellows 17 made of stainless steel or inconel (registered trademark) is disposed within the vacuum vessel 10 concentrically with the cylindrical arc-shield member 16. The cylindrical bottom portion 17a of the bellows 17, extended downwards from the inner diameter portion of one opening end of the bellows 17 along the axial direction of the bellows 17, is fitted and hermetically brazed to the base portion 16a of the cup-shaped arc-shield member 16. The bellows 17 is provided in the conventional manner to allow for vertical movement of the movable electrical contact rod 18 as shown in the drawings without impairing vacuum inside the vacuum vessel 10.

A movable electrical contact rod 18 made of copper or of a copper alloy is inserted into the bellows 17 and the center peripheral portion thereof is hermetically brazed to the inner-diameter top center portion of the bellows 17. The extended end of the movable electrical contact rod 18 located within the vacuum vessel 10 is provided with the movable electrical contact 12 made of a metal similar to that of the contact rod 18 and brazed thereto.

An annular auxiliary metal fitting 19 is fitted and hermetically brazed to a hole provided at the central portion of the bottom portion of the bell-shaped metallic casing 13.

The auxiliary metal fitting 19 made of copper or of a copper alloy is provided to increase the current collecting efficiency of a stationary electrode lead 24 attached thereto. The stationary electrical contact rod 20 made of copper or of a copper alloy is inserted through the central portion of the auxiliary metal fitting 19. The extended end of the stationary electrical contact rod 20 located within the vacuum vessel 10 is provided with the stationary electrical contact 11 described above made of copper or of a copper alloy, brazed thereto, and from which the movable electrical contact 12 can be separated.

It will be seen that each phase vacuum power interrupter unit 3 of such construction is mounted on the supporting portion 5 of the insulating molded block 2, each movable electrical contact rod 18 is inserted through the bore 9 provided at the supporting portion 5, and the insulating circular end plate 14 and the lip 13a of the bell-shaped metallic casing 13 are burried into the supporting portion 5 of the insulating molded block 2 to increase atmospheric creepage distance of the individual vacuum power interrupter units and to increase a mechanical support thereof due to a stress applied to the lip portion of the metallic casing and circular end plate during molding process.

A first rectangular insulating barrier 21 perpendicular to the supporting portion 5 of the insulating molded block 2 is integrally formed therewith at both ends thereof and between adjacent vacuum power interrupter units 3. A pair of supporting poles 22a and 22b integrally formed with the supporting portion 5 of the insulating molded block 2 are disposed upwardly at both sides of each phase vacuum power interrupter unit 3 and perpendicular to the aligned direction of the vacuum power interrupter units 3.

Across the top end of each pair of supporting poles 22a and 22b, the stationary lead 24 made of copper or a copper alloy extends in a direction perpendicular to the aligned direction of the vacuum power interrupter units 3.

Figure 3:
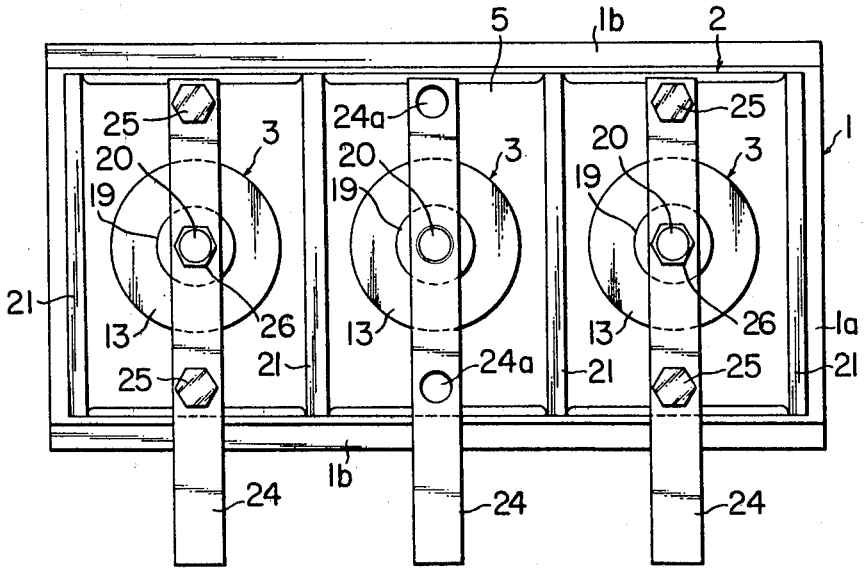
FIG. 3 is a top plan view of the three-phase circuit breaker according to the present invention.

As shown in FIG. 2 and FIG. 3, the stationary electrode lead 24 is mounted on each of the supporting poles 22a and 22b by means of a bolt 25 threaded into the metal fitting 23 through a hole 24a of the stationary electrode 24.

Each of the stationary electrodes lead 24 is connected to a three-phase power source or load. The stationary electrical contact rod 20 is inserted through a hole of the stationary electrode lead 24 and fixed by means of a nut 26 on the threaded portion thereof.

It will be seen that each first insulating barrier 21 is taller than the elongated top end of the stationary contact rod 20.

As shown in FIG. 1 and FIG. 2, a second cylindrical electrode lead supporting pole 27 is integrally formed with the insulating molded block 2 and extending downwards from each of the supporting portions 5 of the insulating molded back 2 to an intermediate portion of each supporting member 6a located on the right side in FIG. 2. A metal fitting 28 is provided at a lower end of each second electrode lead supporting pole 27.

An elongated movable electrode lead 29 extends in parallel to the stationary electrode lead 24 described above and if fixed at the near of one end thereof to each second electrode lead supporting pole 27 by means of a bolt 30 upwards into the metal fitting 28.

The elongated movable electrode lead 29 made of copper or of a copper alloy is connected to a three-phase power source or load. A ring metal fitting 32 is inserted between the head of the bolt 30 and the near end of the movable electrode lead 29. One end of a flexible lead 31 is connected electrically to the movable electrode lead 29 via the ring metal fitting 32 and another end thereof is connected to the movable electrical contact rod 18 via another ring metal fitting 33.

As shown in FIG. 1 and FIG. 2, an actuating mechanism 4 comprises an insulating operating rod 34 made of a resin formed independently of the insulating molded block 2 and molded in the same way as the insulating molded block 2 and screwed on the movable electrical contact rod 18 by means of a metal fitting 35 attached thereinto and two electromagnets. Each insulating operating rod 34 transmits the actuating force produced by electromagnets to the movable electrical contact rod 18, while the gap between the electrically insulating operating rod 34 connected to the movable electrical contact rod 18 and electromagnets causes the movable electrical contact rod 18 to move along its axial direction. If the insulating insulating rod 34 is turned toward a proper direction, the insulating block 34 can be removed from the movable electrical contact rod 18 and can be fixed at a desired position, tightly holding the metal fitting 33 by means of a lock nut 36 screwed on the movable electrical contact rod 18. Furthermore, a flange 37 is integrally molded at the central portion of the insulating operating rod 34 to increase the atmospheric creepage distance from the movable electrical contact rod 18 serving as the electrically charged position. A metal fitting 38 is provided at lower end of the insulating operating rod 34. An armature plate 40 made of a magnetic material such as iron is fixed on the lower end of the insulating operating rod 34 by means of a bolt 39 screwed onto the metal fitting 38.

It will be seen from FIG. 1 and FIG. 2 that a second rectangular insulating barrier 41 is provided between the pair of supporting members 6a and 6b so as to insulate each movable contact rod 18 molded integrally with the insulating molded block 2 for increasing the dielectric strength between each movable electrical contact rod 18. The second insulating barrier 41 extends downwards from the supporting portion 5 of the insulating molded block 2 to the near lower end of the insulating operating rod 34.

As shown in FIG. 1 and FIG. 2, the actuating mechanism 4 is located on the base plate 1 between the pair of supporting members 6a and 6b so as to actuate each vacuum power interrupter unit 3 simultaneously to move each movable electrical contact 12 away from each stationary electrical contact 11.

In the preferred embodiment as shown in the drawings, the actuating mechanism 4 comprises two electromagnets properly spaced from each other. In more detail, two cylindrical iron cores 43 around the periphery of which a winding 42 is uniformly wound are provided separately from each other, one end of each cylindrical iron core facing toward the armature plate 40 and the other end installed on the mounting portion 1a of the base plate 1 by means of a bolt 44.

A circular winding supporting portion 43a is integrally formed at the upper end of each iron core 43 so that the armature plate 40 is brought in contact therewith and to tightly hold the winding 42.

These two electromagnets are excited as to have different polarities. Therefore, in this state a magnetic circuit of the actuating mechanism 4 using the electromagnets is created with the armature plate 40, one iron core 43, base plate 1, and the other iron core 43. As shown in FIG. 2, a lead terminal 45 for the winding 42 is provided beside the winding 42.

When each winding 42 of the electromagnets is energized, the armature plate 40 is attracted toward the winding supporting portion 43a of each iron core 43 so that each phase insulating operating rod 34 is moved downwards together with the relevant movable electrical contact rod 18. In this way, each movable electrical contact 12 is moved away from the stationary contact 11, that is, each phase vacuum power interrupter unit 3 is simultaneously opened.

When each winding 42 is deenergized, the vacuum power interrupter units 3 are closed again, that is, the movable electrical contact 12 of each vacuum interrupter unit 3 is moved upwards in contact with the stationary electrical contact 11 due to the exertion of its self-closing force generated by the internal and external air pressure difference inherent to each vacuum vessel 10 described hereinabove.

As described hereinbefore, according to the present invention, there is provided a vacuum circuit breaker using at least-one bell-shaped vacuum power interrupter unit which includes a bell-shaped vacuum vessel of a metallic casing at the outer peripheral surface of the opening end of which a lip having a larger outer diameter than its tubular portion is formed, an insulating circular end plate made of a ceramic material fitted to the opening end of the metallic casing hermetically sealing the vacuum vessel, a stationary electrical contact rod extending through the bottom portion of the metallic casing having a stationary electrical contact at the extended end thereof within the vacuum vessel, a movable electrical contact rod extending through a bore of the insulating circular end plate and having a movable electrical contact which can either be moved in contact with or be away from the stationary electrical contact provided at the extended end therof within the vacuum vessel, wherein the outer surface of the insulating circular end plate and lip portion of the metallic casing are burried into an insulating molded block made of a resin and a pair of stationary electrode supporting poles integrally formed with the insulating molded block and positioned symmetrically at the outside of the metallic casing are installed so that an elongated stationary electrode is supported by the pair of supporting poles connected to the stationary electrical contact rod.

Consequently, not only the bell-shaped vacuum power interrupter unit can be rigidly mounted on the insulating molded block but also atmospheric dielectric strength can be increased, so that vacuum circuit breaker capable of interrupting a large current with a higher voltage is obtained.

In addition, since the stationary elongated electrode is in contact with the bottom flat portion of the vacuum power interrupter unit and the vacuum power interrupter unit is securely mounted on the insulating molded block, the vacuum circuit breaker can sufficiently withstand an impulse force produced when the vacuum circuit breaker opens or closes a large current with a high voltage.

Although the three-phase vacuum circuit breaker is decribed in detail in this preferred embodiment, the present invention may apply equally to a single-phase vacuum circuit breaker. Furthermore, the actuating mechanism may be hydraulic or pneumatic.

It should be understood that the foregoing relates to only a preferred embodiment of the invention, and that it is intended to cover all changes and modifications of the example of the invention herein chosen for the purpose of the disclosure, which do not constitute departures from the spirit and scope of the invention. The scope of the invention, therefore, is to be determined by the following claims.

What is claimed is:

1. A vacuum circuit breaker having at least one vacuum power interrupter unit comprising:

(a) a bell-shaped metallic casing having a radially extending portion provided in the vicinity of an open end thereof;

(b) an insulating circular end plate made of a ceramic material fitted to the opening end of said bell-shaped metallic casing so as to form a vacuum vessel together with said bell-shaped metallic casing;

(c) a stationary electrical contact rod extending into said bell-shaped metallic casing and having a stationary electrical contact provided at the extending end thereof;

(d) a movable electrical contact rod extending into said bell-shaped metallic casing so as to move relative to said stationary electrical contact rod and having a movable electrical contact at the extending end thereof; and (e) an actuating mechanism disposed below said movable electrical contact rod for opening said movable electrical contact with respect to said stationary electrical contact, the improvement wherein a peripheral surface of said insulating circular end plate outside said vacuum vessel and a radially extending surface portion of said bell-shaped metallic casing are embedded into an insulating molded block made of a resin, the remaining surface portion of said bell-shaped metallic casing being exposed to air.

2. The vacuum circuit breaker as set forth in claim 1, wherein the vacuum circuit breaker is provided with a pair of supporting poles integrally formed with said insulating molded block, parallel to an axis of said stationary and movable electrical contact rods and spaced apart from said bell-shaped metallic casing, and a stationary electrode lead connected to said stationary electrical contact rod and mounted on said pair of supporting poles perpendicular to the axis of said stationary and movable electrical contact rods.

3. The vacuum circuit breaker as set forth in claim 1, wherein there is provided a movable electrode lead connected to said movable electrical contact rod via a flexible lead and wherein said movable electrode lead is mounted on another electrode lead supporting pole integrally formed with said insulating molded block extending in parallel with the axis of said stationary and movable electrical contact rods opposite said pair of supporting poles.

4. The vacuum circuit breaker as set forth in claim 2, wherein the vacuum interrupter unit further includes an annular auxiliary metal fitting fitted into a hole provided in the bottom center of said bell-shaped metallic casing through which the stationary electrical contact rod extends for increasing a current collecting efficiency of said stationary electrode lead.

5. The vacuum circuit breaker as set forth in claim 1, wherein said actuating mechanism is disposed within a space between a pair of elongated supporting members integrally formed with said insulating molded block and extending longitudinally in parallel with the axis of said stationary and movable electrical contact rods opposite said pair of supporting poles and said actuating mechanism comprises:

(a) at least one insulating operating rod, one end of which is attached to said movable electrical contact rod, the other end of which is provided with an armature plate and having a flange portion provided at the center thereof; and (b) a electromagnet member having at least one magnetic core around which a winding is wound for producing a magnetic field at said magnetic core.

6. The vacuum circuit breaker as set forth in claim 2, wherein the vacuum circuit breaker is a three phase breaker which comprises three vacuum power interrupter units disposed in parallel with each other and wherein there is provided on insulating barrier located outside each bell-shaped metallic casing of each vacuum power interrupter unit, integrally formed with said insulating molded block and extending axially with respect to said stationary and movable electrical contact rods and vertically with respect to said pair of supporting poles.

7. The vacuum circuit breaker as set forth in claim 6, wherein there is provided another insulating barrier formed integrally with said insulating molded block extending axially with respect to said stationary and movable electrical contact rods of each vacuum power interrupter unit for isolating each movable electrical contact rod from the other movable electrical contact rods of the opposing vacuum power interrupter units.

8. The vacuum circuit breaker as set forth in claim 9, wherein said actuating mechanism comprises:

(a) three insulating operating rods, each one end of which being individually connected to one end of said movable electrical contact rod which is outside said vacuum vessel of the corresponding vacuum power interrupter unit and having a flange portion at the center thereof;

(b) an armature plate extending horizontally so that the other end of each insulating operating rod is attached thereto by means of a fastening means, and (c) at least one electromagnet located so that each movable electrical contact of the three vacuum power interrupter units can simultaneously be drawn away from each corresponding stationary contact via said insulating operating rod by attracting said armature plate when energized.

* * * * *

UNITED STATES PATENT AND TRADEMARK OFFICE

CERTIFICATE OF CORRECTION

PATENT NO. : 4,421,961

DATED : December 20, 1983

INVENTOR(S) : Shinzo Sakuma et al

It is certified that error appears in the above-identified patent and that said Letters Patent is hereby corrected as shown below:

Item 73 (assignee data) please insert the following after "Japan" --Kabushiki Kaisha GEMVAC, Tokyo, Japan--

Signed and Sealed this

*Eleventh* Day of *September 1984*

[SEAL]

*Attest:*

GERALD J. MOSSINGHOFF

*Attesting Officer*

*Commissioner of Patents and Trademarks*